US010345848B2

(12) United States Patent
Schaub et al.

(10) Patent No.: US 10,345,848 B2
(45) Date of Patent: Jul. 9, 2019

(54) JOYSTICK WITH INTRINSICALLY SAFE FEEDBACK

(71) Applicant: elobau GmbH & Co. KG, Leutkirch (DE)

(72) Inventors: Ulrich Schaub, Ulm (DE); Ingmar Stohr, Leutkirch (DE); Roland Waldner, Wiggensbach (DE)

(73) Assignee: elobau GmbH & Co. KG, Leutkirch (DE)

( * ) Notice: Subject to any disclaimer, the term of this patent is extended or adjusted under 35 U.S.C. 154(b) by 504 days.

(21) Appl. No.: 14/663,766

(22) Filed: Mar. 20, 2015

(65) Prior Publication Data

US 2015/0268691 A1 Sep. 24, 2015

(30) Foreign Application Priority Data

Mar. 24, 2014 (DE) ..... 10 2014 103 988

(51) Int. Cl.
*G05G 5/03* (2008.04)
*G05G 5/05* (2006.01)
*G05G 9/047* (2006.01)

(52) U.S. Cl.
CPC ..... *G05G 5/05* (2013.01); *G05G 5/03* (2013.01); *G05G 9/047* (2013.01); *G05G 2009/04766* (2013.01); *Y10T 74/20201* (2015.01)

(58) Field of Classification Search
CPC .. G05G 5/03; G05G 5/04; G05G 5/05; G05G 2009/04766
See application file for complete search history.

(56) References Cited

U.S. PATENT DOCUMENTS 3,308,675 A * 3/1967 Jonsson ..... F41A 27/06 200/6 A
4,523,911 A * 6/1985 Braetsch ..... A61C 1/0023 251/295
5,228,356 A * 7/1993 Chuang ..... G05G 9/047 200/6 A (Continued)

FOREIGN PATENT DOCUMENTS

CN 1551270 A 12/2004
DE 102011101123 A1 11/2012

(Continued)

*Primary Examiner* — William Kelleher
*Assistant Examiner* — Gregory T Prather
(74) *Attorney, Agent, or Firm* — Notaro, Michalos & Zaccaria P.C.

(57) ABSTRACT

The present invention relates to an operator control element, in particular a joystick, comprising a housing, an activation lever which is mounted in the housing so as to be pivotable about a pivot point, and a resetting unit for making available a resetting torque for resetting the activation lever from a deflected state into a neutral state. In order to specify an operator control element which makes available a haptic force feedback which is intrinsically safe, the invention proposes that the operator control element comprises an actuator unit which is operatively connected to the resetting unit, wherein the actuator unit is designed to perform limited modulation of the resetting torque, wherein in the case of a lower modulation limit the resetting torque in the deflected state is greater than zero.

9 Claims, 9 Drawing Sheets

(56) References Cited

U.S. PATENT DOCUMENTS

| | | | | |
|---|---|---|---|---|
| 2002/0075225 | A1* | 6/2002 | Schena | A63F 13/06 345/156 |
| 2004/0259687 | A1* | 12/2004 | Ritter | B60K 26/021 477/187 |
| 2007/0245844 | A1* | 10/2007 | Yokoyama | B60K 26/021 74/470 |
| 2013/0327173 | A1* | 12/2013 | Iwata | F16H 59/105 74/473.12 |

FOREIGN PATENT DOCUMENTS

| | | | |
|---|---|---|---|
| EP | 2078998 | A2 | 7/2009 |
| GB | 2482409 | A | 2/2012 |
| JP | 2006193012 | A | 7/2006 |
| JP | 2011154447 | A | 8/2011 |
| WO | 2005043269 | A1 | 5/2005 |

* cited by examiner

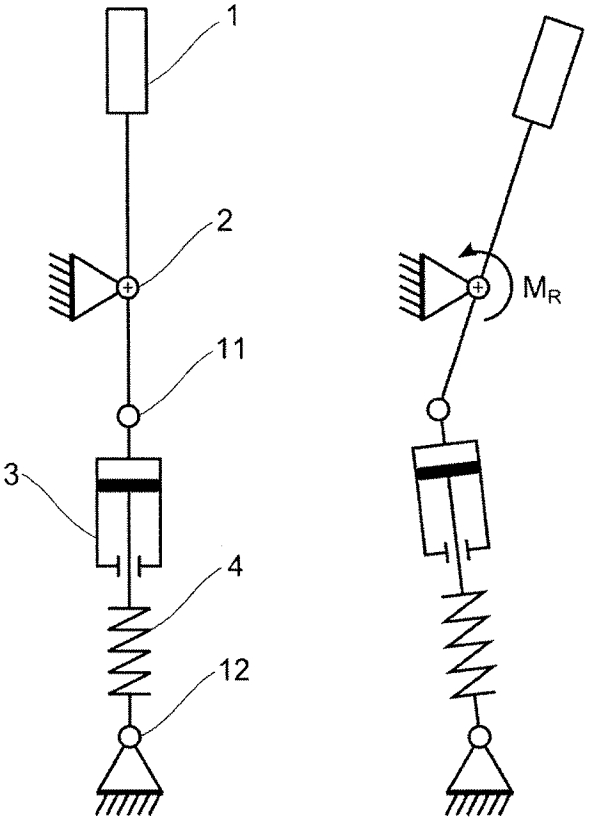
Fig. 7a
Fig. 7b
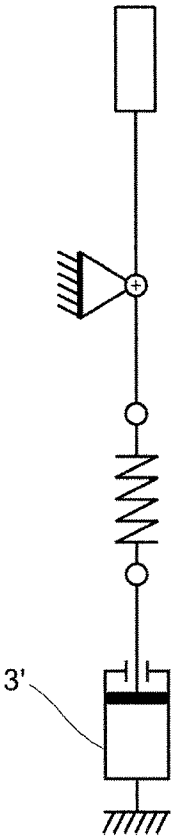
Fig. 7c
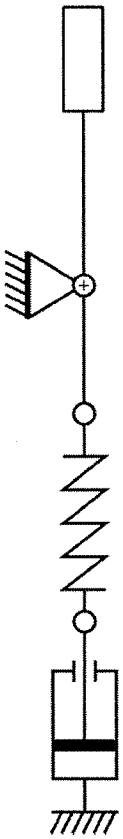
Fig. 7d
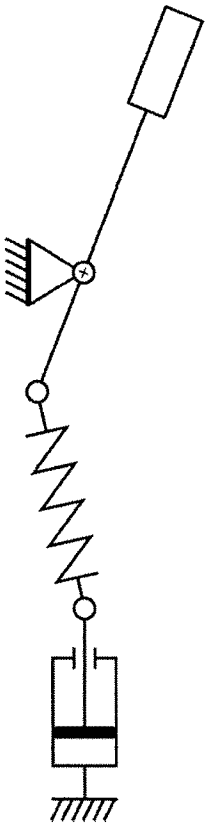
Fig. 7e

JOYSTICK WITH INTRINSICALLY SAFE FEEDBACK

The present invention relates to an operator control element, in particular a joystick, comprising a housing, an activation lever which is mounted in the housing so as to be pivotable about a pivot point, and a resetting unit for making available a resetting torque for resetting the activation lever from a deflected state into a neutral state.

Such operator control elements are used, inter alia, to control utility vehicles, machines, working functions of utility vehicles or construction machines and accessory equipment. Operator control elements in the sense of the invention are, for example, control levers, accelerator pedals and, in particular, joysticks. Such joysticks are associated with the electrical control systems. In contrast to the earlier mechanical control systems, such electrical control systems do not pass on any feedback whatsoever from the mechanical system to the user. It is therefore known to provide the joysticks with a force feedback, which is usually achieved by coupling a torque of an electric motor to the activation lever of the joystick via a gear mechanism. However, it is disadvantageous with such structures that the joystick can be deflected from its position of rest even without a user input, for example by a malfunction of the control of the force feedback. Such a malfunction would cause a machine or a vehicle to be automatically set in motion, which is correspondingly dangerous. In the field of motor vehicles, such force feedback solutions are already known for accelerator pedals in which it must also be unconditionally ensured that the accelerator pedal does not accelerate the vehicle automatically as a result of a fault. However, in contrast to accelerator pedals, joysticks have at least two deflection directions out of their position of rest. The known solutions for accelerator pedals therefore cannot be transferred to a joystick. A force feedback for a joystick must therefore not deflect out of the neutral position under any circumstances, and in the case of a fault the joystick must continue to return automatically to the neutral position when it is released by the user. In addition, the joystick should continue to remain usable even in the case of a fault in the force feedback system, in order to avoid putting the availability of the vehicle or of the machine at risk.

Force feedback is marketed, for example, for functions of simulators of any type at mass production sales prices, in particular in the case of joysticks for computer games. The force feedback is as a rule implemented structurally with motors which act directly on the axes and bring about the desired haptic feedback with control technology. However, since this use does not directly result in danger to the user, faults can readily be tolerated, and replacement is easily possible. In the case of aircraft which fly by means of what is referred to as fly-by-wire systems, owing to the high safety risk in the event of a malfunction in the force feedback system a backup controller with mechanical transmission is as a rule additionally installed. In aeronautical engineering, the force feedback is also referred to as artificial feel.

All these known devices have in common the fact that they do not ensure that independent movement of the joystick is ruled out or they can avoid such a movement with a high level of probability only by means of redundant monitoring of the electronic actuation of the force feedback system. However, a malfunction of the force feedback system cannot be entirely ruled out and would, under certain circumstances, be perceptible in an independent movement of the joystick.

Even if an independent movement of the joystick is prevented by redundant monitoring of the electronics, a loss of function of the joystick can occur when components fail. This can in turn lead to a situation in which the joystick no longer returns independently into its neutral position when released by the user, said neutral position being the safe state in most applications. Even if this case could also be detected by monitoring electronics, it would constitute a considerable restriction of the availability of the joystick and of the system to be controlled therewith and would have a negative effect on the acceptance with users.

The object of the present invention is therefore to specify an operator control element of the type mentioned at the beginning which makes available haptic force feedback which is intrinsically safe.

This object is achieved according to the invention in that the operator control element comprises an actuator unit which is operatively connected to the resetting unit, wherein the actuator unit is designed to perform limited modulation of the resetting torque, wherein in the case of a lower modulation limit the resetting torque is greater than zero in the deflected state. The resetting torque is positive in all the deflected states which are to be changed into the neutral state when required, with the result that the activation lever returns autonomously to the neutral state after release by the user, and remains in said state. Since in the event of a released, deflected operator control element a resetting torque is always present and a deflection torque is not, there is only a torque in the direction of the position of rest of the activation lever. This very advantageously ensures that the operator control element behaves in a way that is analogous to a purely passive joystick which is reset by means of springs. If the operator control element according to the invention is released it returns automatically into the position of rest. It cannot move automatically out of said position even in the event of a malfunction of the drives or of the electronics.

According to the invention it proves particularly advantageous that in the case of an upper modulation limit the resetting torque is smaller than a deflection torque which can be applied by a user and has the purpose of deflecting the activation lever. It is therefore ensured that the operator control element can be deflected by the user even in the case of a malfunction or failure of the drives or of the electronics, with the result that the system which is to be controlled by means of the operator control element continues to remain usable. The resetting torque in the deflected state is advantageously 0.001 Nm to 10.0 Nm. In particular, the maximum resetting torque in the case of maximum deflection of the activation lever is 4.0 Nm or 6.0 Nm. The maximum resetting torque is set to be relatively small so that a typical user of the operator control element, for example a construction worker or agricultural worker, can, when necessary, overcome the maximum resetting torque without difficulty and therefore has control over a deflection process of the activation lever at any time. The user-dependent deflection torque which can be applied can be determined easily with methods which are known to a person skilled in the art. For example, a series of trials could be carried out, wherein the maximum resetting torque is increased incrementally and the user of the operator control element attempts at every step to deflect the activation lever further counter to the instantaneously present resetting torque. As long as the user is able to do this, the resetting torque which is present in the case of an upper modulation limit, which corresponds to the maximum resetting torque, is smaller than the deflection torque which can be applied by the relevant user.

The lower modulation limit or the upper modulation limit or both modulation limits are preferably implemented mechanically according to the invention by means of structural measures. Electronic monitoring, which, under certain circumstances, even has to be kept available redundantly, for the force feedback system according to the invention is very advantageously not necessary.

Furthermore, there is provision according to the invention that the resetting unit has a compliance element, wherein the actuator unit is designed to modulate a resetting characteristic of the compliance element. The actuator therefore influences the striving of the resetting unit to return the activation lever to the neutral state, but only within the modulation limits, in order to avoid putting at risk the intrinsically safe resetting of the activation lever. In the above defined framework of the modulation, the actuator unit permits various items of haptic feedback to be communicated to the user in the activation lever. For example, the operator control element according to the invention permits characteristic curves to be personalized, switching over between various characteristic curve forms depending on their operating state and generally allows system states to be made available for the haptic perception of the user. Such information which is made available does not have to be perceived by the user visually anymore, which typically relieves the load on the user and permits him to concentrate better on his primary task. The degree of deflection of the activation lever, the reaching of the load limit of the system or an alarm are mentioned as examples of system states. The compliance element is preferably arranged between the activation lever and the actuator system which generates the force feedback. The resetting unit can comprise one or more compliance elements.

According to the invention, the compliance element has a compression spring or a tension spring or a gas piston or a magnet. In particular, a compliance element is understood to mean the following: spiral spring, leg spring, helical spring, leaf spring, torsion spring, air spring, gas pressure spring, elastomer spring or magnetic repulsion. Gear mechanism elements for transmitting an actuation travel of the actuator unit can be arranged between the actuator unit and the compliance element. Of course, other compliance elements are also conceivable according to the invention if they are compatible with the further components of the operator control element.

It proves very advantageous according to the invention that the resetting unit has a cam, and a probe element which contacts the cam in any position of the activation lever, wherein the actuator unit is designed to modulate a contact pressure force of the probe element against the cam in terms of absolute value and/or direction. A cam-probe element combination is generally known in particular in the case of joysticks, and is used often and has proven its worth. With this proven combination, according to the invention an actuator unit is effectively connected in order to be able to feed additional feedback into the activation lever and improve the proven combination further. The probe element has a ball or a roller or a cam.

As an alternative to this, there is provision according to the invention that the resetting unit has two magnets, wherein the actuator unit is designed to modulate a magnetic force acting between the magnets, in terms of absolute value and/or direction, in order to influence the resetting torque of the resetting unit.

In a further alternative, there is provision according to the invention that the resetting unit has a linear chain, one end of which is attached to the housing and the other end of which is attached to the activation lever, and which resetting unit comprises the compliance element, wherein the actuator unit is designed to modulate a prestress of the compliance element, in order to influence the resetting torque of the resetting unit.

It proves particularly advantageous according to the invention that the actuator unit is designed to make available an intrinsically limited actuation travel. Such structural limitations for the actuation travel of the actuator unit ensure that a torque acting on the activation lever is always a resetting torque which moves, under all circumstances between a safe minimum and a safe maximum, and the activation lever automatically returns into the neutral position and is not restricted in its deflection. It is not possible for automatic movement of the activation lever out of the neutral state to occur as a result of any position of the actuator unit.

As an alternative or in addition to an intrinsically limited actuation travel, the operator control element has stops for limiting an actuation travel of the actuator unit. By means of this configuration, it is possible to use a type of actuator unit for installation in different operator control elements with respect to the permitted actuation travel.

This permits the use of structurally simpler or generalized actuator units, which results in reduced manufacturing costs for the operator control element according to the invention.

There is provision according to the invention that the actuator unit has an actuator, wherein the actuator is embodied as an electric motor or an electrodynamic linear drive or a piezoelectric drive or an electromagnet or an pneumatic drive or a hydraulic drive. According to the invention, the piezoelectric drive comprises at least one of the following piezoelectric elements: stacks, bending bars and travelling wave motors. Of course, other actuators are also conceivable according to the invention if they are compatible with the further components of the operator control element.

Combinations of the actuator and compliance element which are preferred according to the invention are: an electric motor and compression spring or tension spring or gas piston or magnet or spiral spring or leg spring or helical spring or leaf spring or torsion spring or air spring or gas pressure spring or elastomer spring; electrodynamic linear drive and compression spring or tension spring or gas piston or magnet or spiral spring or leg spring or helical spring or leaf spring or torsion spring or air spring or gas pressure spring or elastomer spring; piezoelectric drive and compression spring or tension spring or gas piston or magnet or spiral spring or leg spring or helical spring or leaf spring or torsion spring or air spring or gas pressure spring or elastomer spring; electromagnet and compression spring or tension spring or gas piston or magnet or spiral spring or leg spring or helical spring or leaf spring or torsion spring or air spring or gas pressure spring or elastomer spring; pneumatic drive and compression spring or tension spring or gas piston or magnet or spiral spring or leg spring or helical spring or leaf spring or torsion spring or air spring or gas pressure spring or elastomer spring; and hydraulic drive and compression spring or tension spring or gas piston or magnet or spiral spring or leg spring or helical spring or leaf spring or torsion spring or air spring or gas pressure spring or elastomer spring.

In a simplified embodiment of the present invention, the actuator unit has an actuator, wherein the actuator is arranged outside the operator control element. The externally positioned actuator is connected by means of an operative connection to a further part of the actuator unit which acts on the resetting unit in order to perform limited modulation of the resetting torque. The operator control element therefore does not require any internal actuator, which simplifies the design of the operator control element and reduces the manufacturing costs for the operator control element. The external actuator is particularly preferably an actuator which is present in any case in the machine or the vehicle which has the operator control element. For example, the external actuator is a hydraulic cylinder of an excavator arm of an excavator, wherein the excavator arm is connected to the operator control element by means of a linkage in order to control the excavator, and the linkage is coupled to the resetting unit in order to modulate the resetting torque in a limited fashion in a direct dependence on the position of the excavator arm, and therefore to influence the characteristic curve of the operator control element.

In a further simplified embodiment of the present connection, the actuator unit has an actuator element instead of an actuator. Compared to an actuator, an actuator element is a technically less complex component which generally requires no power supply. The actuator element is preferably a mechanical actuator element, for example a lever or an actuating screw, which acts on the resetting unit in order to perform limited modulation of the resetting torque, and therefore changes the characteristic curve of the operator control element. The use of an actuator element instead of an actuator is expedient, in particular, when the characteristic curve of the operator control element has to be changed only relatively rarely, for example once the characteristic curve has been adapted to the requirements of the user and subsequently no further situation-dependent modulation of the characteristic curve is desired.

In a more general variant of the present invention, the actuator unit has an actuator and an actuator element. The combination of the actuator and actuator element, in particular mechanical actuator element, permits a universally configurable operator control element to be made available by double modulation of the characteristic curve. This operator control element provides the function of the intrinsically safe force feedback, and at the same time the operator control element can be individually configured. The individual configuration of the characteristic curve according to the requirements of the user forms a basic setup for the operator control element, on which the force feedback is superimposed.

Depending on the purpose of use of the operator control element, it proves advantageous according to the invention that the pivot point is embodied as an activation axis or as two activation axes which are oriented orthogonally with respect to one another or as three activation axes which are orthogonal with respect to one another. A pivot point which is embodied as an activation axis permits the operator control element to pivot in merely one plane. As a result, for example a joystick which is simple in terms of bearing technology and robust can be constructed, with which joystick in the minimum case only a single function is implemented. A pivot point which is embodied as two actuation axes which are oriented orthogonally with respect to one another or as three activation axes which are orthogonal with respect to one another permits a very varied configuration of a pivoting pattern for the operator control element, with the result that a plurality of functions can be implemented. In particular in the last alternative the requirements made of the bearing of the activation lever in the housing are demanding, but they can be met by means of, for example, a cardanic bearing.

Furthermore, the operator control element comprises a control unit which interrogates the state of the operator control element, in particular the deflection of the activation lever. From the system, the control unit receives information about an operating mode and, if appropriate, a variable which is to be produced as force feedback at the operator control element. The control unit calculates therefrom the instantaneously necessary modulation of the resetting torque and actuates the actuator unit accordingly.

It is also conceivable that the operator control element has, in addition to the resetting unit a latching device, in order to be able to fix the activation lever at a predefined deflection. During the implementation of the solution according to the invention, angle inaccuracies, vibrations and the like have to be further taken into account. Corresponding characteristic curves or characteristics have to be stored in the electronics of the control unit, which is independent per se of the operator control element.

In the text which follows, the invention will be described by way of example in 14 embodiments with reference to the drawings, wherein further advantageous details can be found in the figures of the drawings.

In the drawings, in each case in detail:

FIG. 7 shows a schematic view of an operator control element according to the invention according to a seventh embodiment;

Figure 1A:
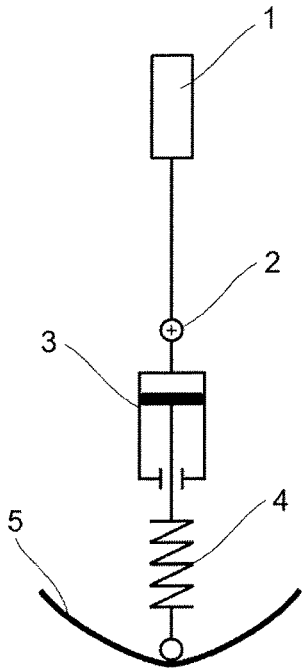
FIG. 1 shows a schematic view of an operator control element according to the invention according to a first embodiment.
Figure 1B:
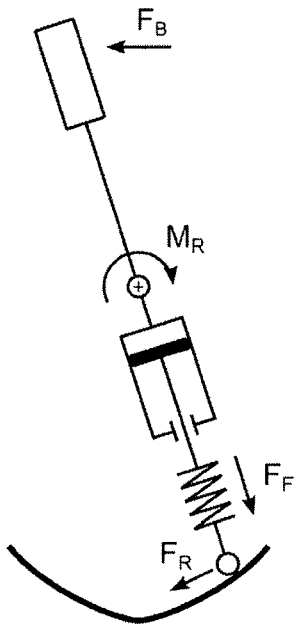

FIG. 1 shows a schematic view of an operator control element according to the invention according to a first embodiment. The operator control element is embodied as a joystick. In the left-hand part of the figure, the joystick is in a neutral state with the actuator unit 3 retracted, and in the right-hand part it is in a deflected state with the actuator unit 3 retracted. The joystick comprises an activation lever 1 with a handle and a handlebar, which is mounted so as to be pivotable about a pivot point 2 in a housing (not shown), and a resetting unit for making available a resetting torque $M_R$ for resetting the activation lever 1 from a deflected state into a neutral state.

Furthermore, the joystick comprises an actuator unit 3 which is operatively connected to the resetting unit, wherein the actuator unit 3 is designed to perform limited modulation of the resetting torque $M_R$, wherein in the case of a lower modulation limit the resetting torque $M_R$ in the deflected state is greater than zero, and wherein in the case of an upper modulation limit the resetting torque $M_R$ is smaller than a deflection torque which can be applied by a user and has the purpose of deflecting the activation lever 1. The resetting unit has a compliance element 4 in the form of a helical spring, wherein the actuator unit 3 is designed to modulate a resetting characteristic of the helical spring. The actuator unit 3 carries out a linear movement in order to make available an actuation travel. The compliance element 4 is connected by one end to the actuator unit 3 and by the other end to the probe element which is guided on a cam 5 and contacts the latter in any position of the activation lever 1. If a user applies a user force $F_B$ to the operator control element, the activation lever 1 is deflected. This causes the compliance element 4 to be compressed by the cam 5. As a result a spring force $F_F$ is produced between the compliance element 4 and the cam 5. Given suitable shaping of the cam 5 and the probe element of the compliance element 4, an angle, which brings about a resetting force $F_R$, is formed between the spring force $F_F$ and the surface normal of the cam 5. In contrast to the prior art, there is now provision according to the invention that the actuator unit 3 additionally generates a variable prestress in the spiral spring. This prestress makes it possible to generate different spring forces $F_F$ and therefore different resetting forces $F_R$ at a constant angular position.

Figure 2:
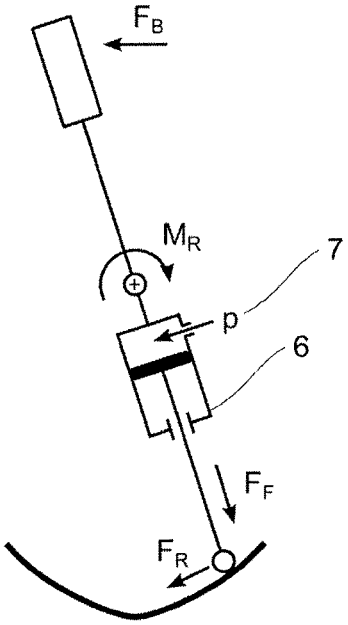
FIG. 2 shows a schematic view of an operator control element according to the invention according to a second embodiment.

FIG. 2 shows a schematic view of an operator control element according to the invention according to a second embodiment in a deflected state. The operator control element is embodied as a joystick. In the second embodiment, the actuator unit 3—compliance element 4—sequence of the first embodiment is replaced by an adjustable compliance element 6, wherein the actuator unit 3 is integrated into the compliance element 4 such as, for example, in gas springs or air springs with a variable internal pressure. In these springs, a gas pressure p can be varied, as a result of which a corresponding spring force $F_F$ is generated.

Figure 3A:
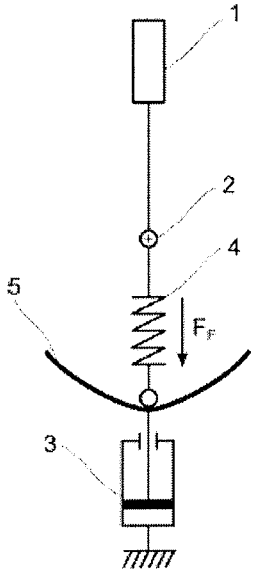
FIG. 3 shows a schematic view of an operator control element according to the invention according to a third embodiment.
Figure 3B:
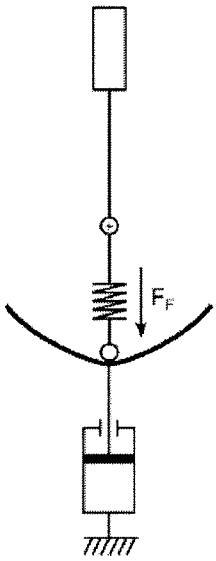

FIG. 3 shows a schematic view of an operator control element according to the invention according to a third embodiment. The operator control element is embodied as a joystick. In the left-hand part of the figure, the joystick is in a neutral state with the actuator unit 3 retracted and in the right-hand part it is in a neutral state with the actuator unit 3 extended. In the third embodiment, the actuator unit 3 does not act directly on the compliance element 4 but rather indirectly in that it adjusts the cam 5 with respect to the compliance element 4. That is to say the cam 5 is embodied so as to be movable in relation to the housing (not shown). This kinematically inverse arrangement also results in a variable prestress of the compliance element 4, which is embodied as a helical spring, and therefore in a variable resetting force $F_R$. As a result of the change in distance between the pivot point 2 and the cam 5, the characteristic curve or characteristic of the helical spring is influenced, with the result that corresponding forces are produced. At the same time, a changed angle between the cam and the compliance element 4 is produced at the same deflection angle. This causes the characteristic curve (resetting torque $M_R$ plotted against the deflection angle) of the operator control element also to change its shape. In particular in this embodiment, the compliance element and the actuator unit can be implemented with various technical means as mentioned at the beginning.

Figure 4A:
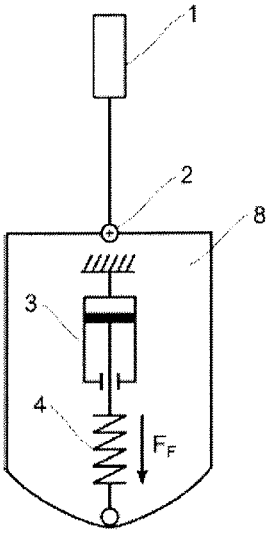
FIG. 4 shows a schematic view of an operator control element according to the invention according to a fourth embodiment.
Figure 4B:
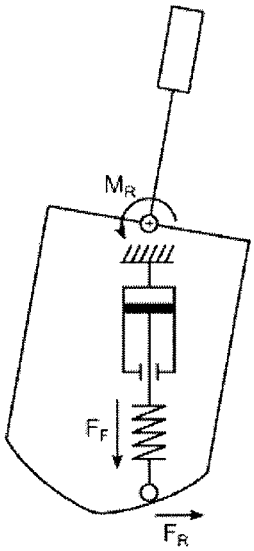
Figure 5A:
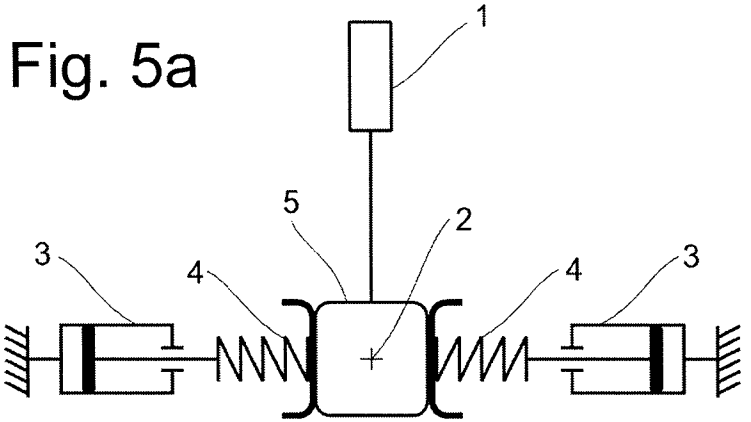
FIG. 5 shows a schematic view of an operator control element according to the invention according to a fifth embodiment.
Figure 5B:
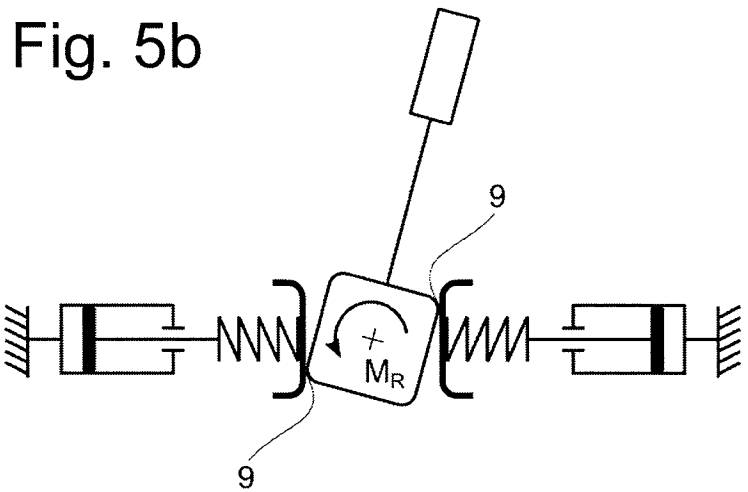
Figure 5C:
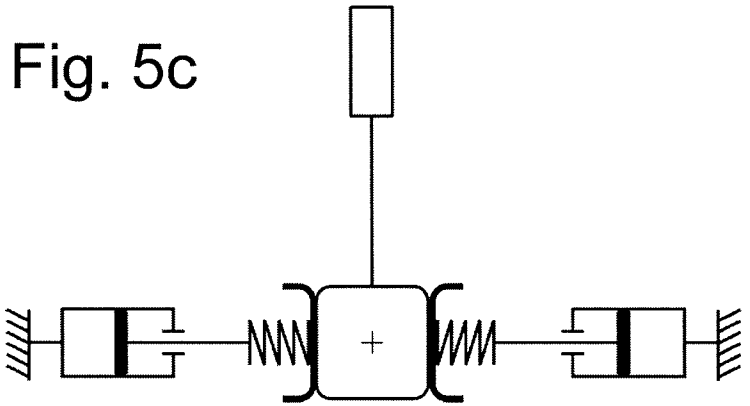
Figure 5D:
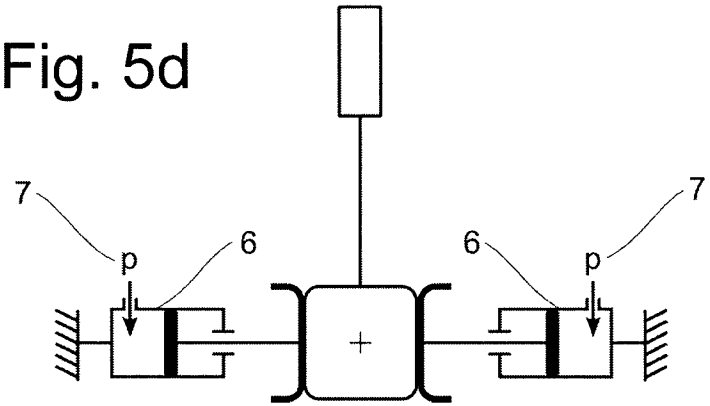

FIG. 4 shows a schematic view of an operator control element according to the invention according to a fourth embodiment. The operator control element is embodied as a joystick. In the left-hand part of the figure, the joystick is in the neutral state with the actuator unit 3 retracted, and in the right-hand part is in a deflected state with the actuator unit 3 retracted. In the fourth embodiment, the activation lever 1 is rotatably mounted at the pivot point 2, but the compliance element 4 and the actuator unit 3 are not attached thereto but instead a cam 8 which is embodied so as to be movable in relation to the housing (not illustrated). Running in this cam 8 is a tappet which has the compliance element 4 and the actuator unit 3 and is, in particular, composed of the compliance element 4 and the actuator unit 3, wherein the tappet can also be replaced by an adjustable compliance element 6 here. If the activation lever 1 is deflected together with the cam 8, a resetting force $F_R$ is produced which is directly proportional to the spring force $F_F$ of the compliance element 4. Compared to the first embodiment, the actuator unit 3 in the fourth embodiment is attached in a positionally fixed fashion to the housing (not illustrated). This has immediate advantages with respect to the design and connection of control lines and supply lines of the joystick.

FIG. 5 shows a schematic view of an operator control element according to the invention according to a fifth embodiment. The operator control element is embodied as a joystick. In the top left-hand part of the figure, the joystick is in a neutral state with the actuator unit 3 retracted, and in the top right-hand part it is in a deflected state with the actuator unit 3 retracted, in the bottom left-hand part it is in a neutral state with the actuator unit 3 extended and in the bottom right-hand part the joystick comprises two adjustable compliance elements 6. In the fifth embodiment, the cam 5 is formed by a right parallelepiped which has rounded corners and is arranged at the pivot point 2. The probe elements of the resetting unit are made available by the planar bearing faces which clamp in the right parallelepiped on two sides. The exact outer shape of the cam 5 is not necessarily a right parallelepiped. Other shapes are not excluded according to the invention and depend on the desired characteristic curve which is to be produced of the compliance element 4. The force is applied to the cam 5 on both sides via a compliance element 4, the prestress of which can be varied in each case with an actuator unit 3. During deflection the activation lever 1 deflects the cam 5 about the pivot point 2. As a result, the force engagement points between the cam 5 and the compliance element 5 change. At the same time, the elongation of the compliance element 4 changes, as a result of which the spring force $F_F$ is varied. In this embodiment, a resetting torque $M_R$ is produced from the spring force $F_F$ and the distance of the force engagement point 9 from the rotational axis 2. It is particularly advantageous that given a symmetrical configuration of the arrangement no bearing forces occur at the rotational axis 2. As already mentioned the actuator unit 3 and compliance element 4 can also be replaced here by an adjustable compliance element 6. According to the invention it is also possible to omit one of the two actuator units 3 and to influence the prestress of the two compliance elements 4 by means of a single actuator unit 3 and a suitable gear mechanism. According to the invention, the planar bearing faces can also be referred to as a cam, and the right parallelepiped as a probe element. Accordingly, the cam would be designed in a planar fashion and the probe element as a cam which acts on two sides.

Figure 6C:
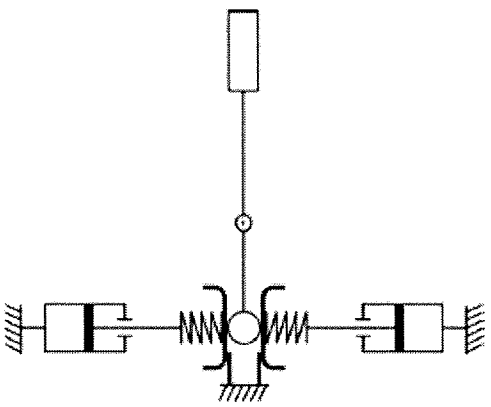
FIG. 6 shows a schematic view of an operator control element according to the invention according to a sixth embodiment.
Figure 6B:
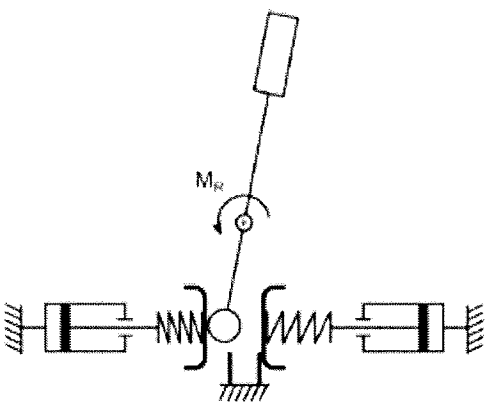
Figure 6A:
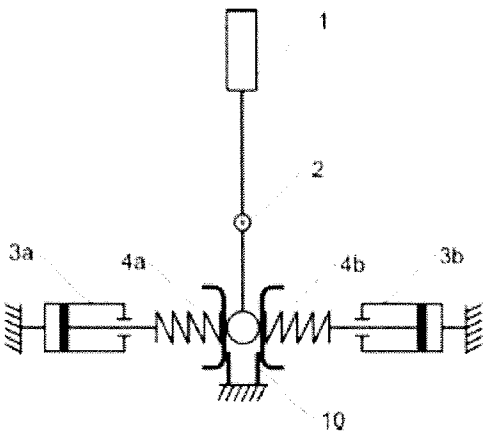

FIG. 6 shows a schematic view of an operator control element according to the invention according to a sixth embodiment. The operator control element is designed as a joystick. In the left-hand part of the figure the joystick is in a neutral state with the actuator unit 3*a*, 3*b* retracted, in the central part it is in a deflected state with the actuator unit 3*a*, 3*b* retracted, and in the right-hand part it is in a neutral state with the actuator units 3*a*, 3*b* extended. In the sixth embodiment, two compliance elements 4*a*, 4*b* act directly on the activation lever 2. Stops 10, which are attached in the housing (not illustrated) ensure that when the activation lever 1 is deflected only one compliance element 4 then acts on the activation lever 1. The actuator units 3*a*, 3*b* permit prestress of the compliance elements 4*a*, 4*b*, and at the same time a parallel shift of the characteristic curve along the torque axis is also brought about by this. In this embodiment, the actuator units 3*a*, 3*b* can very advantageously be actuated in different ways, and can therefore influence the characteristic curve branches to the left and right of the neutral position of the activation lever 1 separately from one another. Embodiments in which the actuator unit 3 and the compliance element 4 are replaced by an adjustable compliance element 6 are also conceivable here. A single actuator unit 3 can also influence both or all of the compliance elements 4 simultaneously by means of a suitable gear mechanism.

FIG. 7 shows a schematic view of an operator control element according to the invention according to a seventh embodiment. The operator control element is embodied as a joystick. In the part of the figure which is 1 from the left the joystick is in a neutral state with the actuator unit 3 retracted, in the part of the figure which is 2 from the left it is in a deflected state with the actuator unit 3 retracted, in the part of the figure which is 3 from the left it is in a neutral state with the actuator unit 3 extended, in the part of the figure which is 4 from the left it is in a neutral state with the actuator unit 3 retracted, and in the part of the figure which is 5 from the left it is in a deflected state with the actuator unit 3 retracted. In the seventh embodiment, the activation lever 1 is, as already described, mounted so as to be rotatable about the pivot point 2. By means of a joint 11 which is attached to the housing (not illustrated), the activation lever 1 is connected to the actuator unit 3, and the latter is connected to the compliance element 4. The compliance element 4 is rotatably mounted in a joint 12 which is attached to the housing (not illustrated). Deflection of the activation lever 1 causes the distance between the joint 11 and joint 12 to increase, as a result of which the spring force $F_F$ generated by the compliance element 4 is increased. A lateral offset of the joint 11 with respect to the pivot point 2 brings about a resetting torque $M_R$. The prestress of the compliance element 4, and therefore the characteristic curve of the joystick, can be varied by means of the actuator unit 3. It is also possible to specify an alternative to this embodiment with a positionally fixed actuator unit 3'.

Figure 8A:
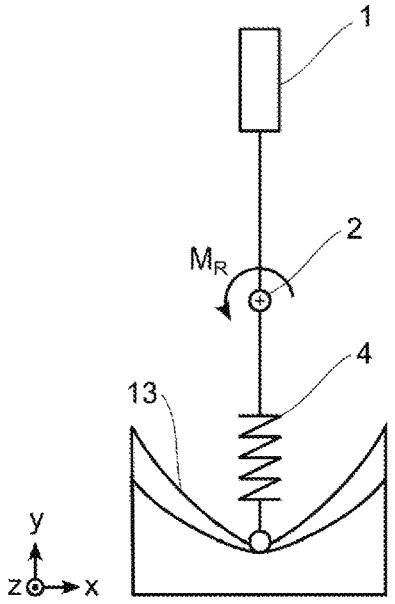
FIG. 8 shows a schematic view of an operator control element according to the invention according to an eighth embodiment.
Figure 8B:
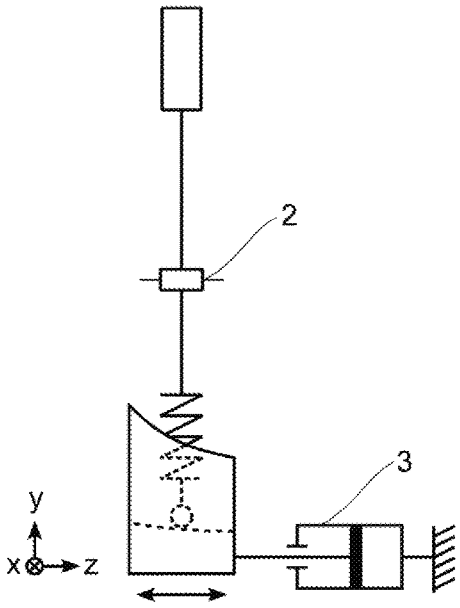

FIG. 8 shows a schematic view of an operator control element according to the invention according to an eighth embodiment. The operator control element is embodied as a joystick. In the left-hand part of the figure, a front view of the eighth embodiment is represented and in the right-hand part a side view. In the eighth embodiment, the compliance element 4 is supported on a cam 5 by means of the probe element. When the activation lever 1 is deflected, a resetting torque $M_R$ occurs as a function of the spring force $F_F$ and the angle between the cam 5 and the activation lever 1. The cam 5 is embodied in this embodiment in such a way that it has different cam sections in the z direction. This is achieved by means of a sliding block 13, wherein the sliding block 13 is embodied so as to be adjustable in the z direction by means of the actuator unit 3. Depending on the position of the sliding block 13, different characteristic curves can be represented. The transitions between the individual characteristic curves can be configured here in an infinitely variable fashion, and alternatively a discrete number of characteristic curves can also be implemented on the sliding block 13.

Figure 9A:
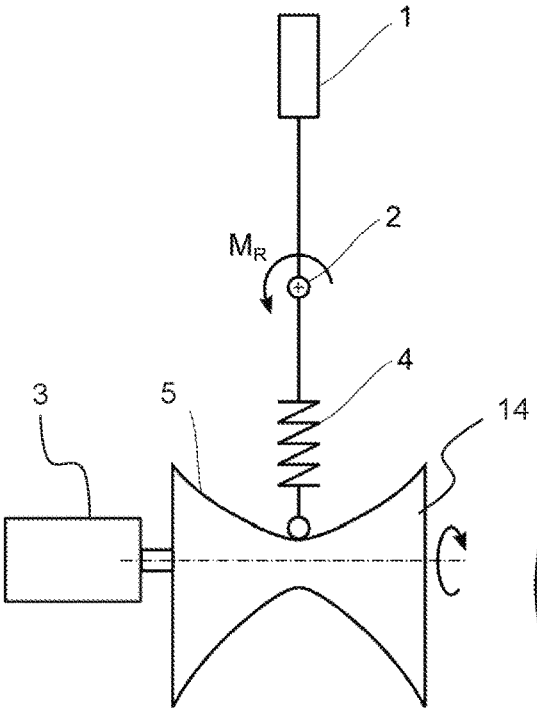
FIG. 9 shows a schematic view of an operator control element according to the invention according to a ninth embodiment.
Figure 9B:
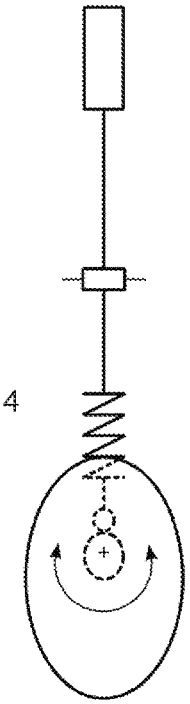

FIG. 9 shows a schematic view of an operator control element according to the invention according to a ninth embodiment. The operator control element is embodied as a joystick. In the left-hand part of the figure, a front view of the ninth embodiment is represented, and in the right-hand part a side view. In the ninth embodiment, the various connecting links are not arranged in a linear fashion but rather on the circumference of a sliding roller 14. By rotating the sliding roller 14 about its longitudinal axis by means of the actuator unit 3 various connecting links 5 can be accessed. In this context, the connecting links 5 can merge continuously one with the other or a discrete number of connecting links 5 can be arranged as planar component segments on the lateral surface of the sliding roller 14. The resetting torque $M_R$ is generated in a fashion analogous to the first or eighth embodiment. The actuator unit 3 comprises an actuator, for example an electric motor, or an actuator element, for example a spring, which makes available rotational movements as an travel.

Figure 10A:
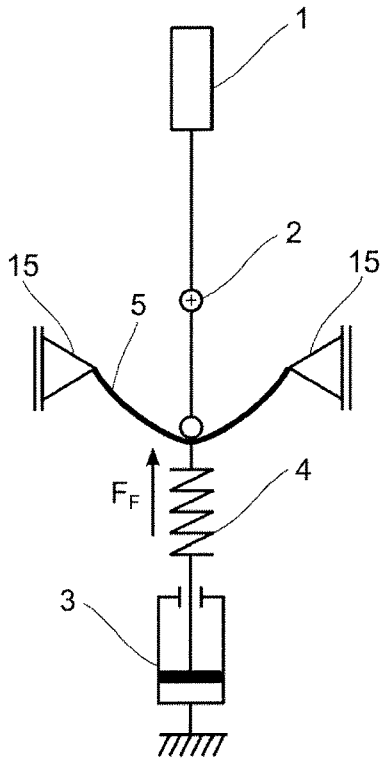
FIG. 10 shows a schematic view of an operator control element according to the invention according to a tenth embodiment.
Figure 10B:
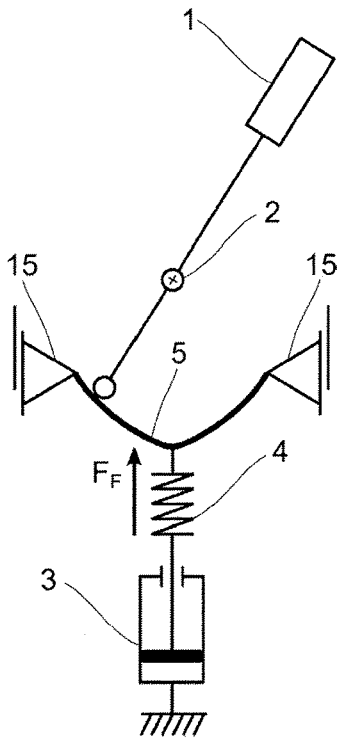

FIG. 10 shows a schematic view of an operator control element according to the invention according to a tenth embodiment. The operator control element is embodied as a joystick. In the left-hand part of the figure the joystick is in a neutral state with the actuator unit 3 retracted, and in the right-hand part it is in a deflected state with the actuator unit 3 retracted. In the tenth embodiment, the compliance element 4 is arranged between the actuator unit 3, which is attached to the housing (not illustrated), and the cam 5. The actuator unit influences the prestress of the compliance element 4. The probe element is connected directly to that end of the activation lever 1 which faces the cam 5, and said probe element slides over the cam 5 when the activation lever 1 is deflected. The cam 5 itself is mounted in a movable fashion, in particular a sliding fashion, in the housing (not illustrated) and is pressed against the activation lever 1 by a compliance element 4 with the spring force $F_F$. In a way which is analogous to the first embodiment, a resetting torque $M_R$ is produced when the activation lever 1 is deflected. The two bearings 15 indicate that the cam 5 is embodied so as to be mainly vertically displaceable.

Figure 11:
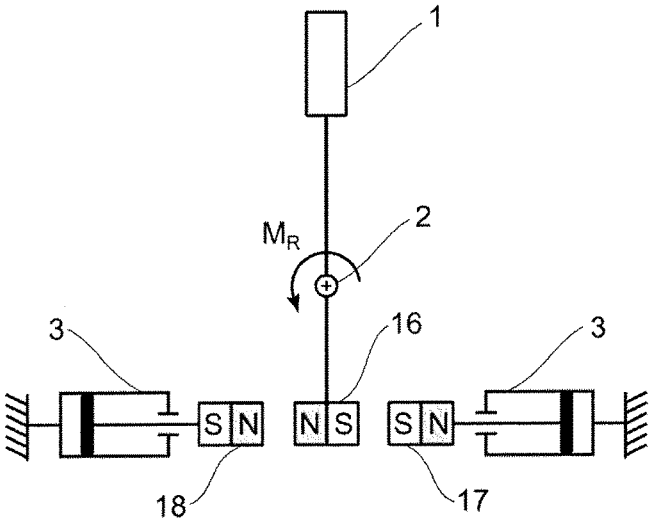
FIG. 11 shows a schematic view of an operator control element according to the invention according to an eleventh embodiment.

FIG. 11 shows a schematic view of an operator control element according to the invention according to an eleventh embodiment, wherein the operator control element which is embodied as a joystick is in a neutral state when the actuator units 3 are retracted. The eleventh embodiment is a magnetic embodiment. A magnet 16 is attached to that end of the activation lever 1 which faces away from the user. To the left and right of this magnet 16, further magnets 17, 18 are arranged oriented in such a way that they each repel the magnet 16. In this way, the joystick is centred in the neutral position or in the neutral state. When the activation lever 1 is deflected, for example a first air gap between the magnet 16 and the magnet 18 becomes smaller, and a second air gap between the magnet 16 and the magnet 17 becomes larger. The repulsion increases in the smaller first air gap and decreases in the larger second air gap. As a result, the behaviour of a compliance element 4 is brought about and a resetting torque $M_R$ is generated. By means of the actuator units 3, the first and second air gaps could be changed and therefore the characteristic curves. It is particularly advantageous to adjust both magnets 17, 18 simultaneously by means of just one actuator unit 3 and one corresponding gear mechanism. The magnets 17, 18 are permanent magnets but according to the invention they could also be replaced by electromagnets. This embodiment requires further protective circuitry measures for shielding the magnets against magnetic interference fields in order to ensure that by means of the resetting unit the activation lever 1 experiences only resetting torques $M_R$ which act in the direction of its neutral position.

Figure 12A:
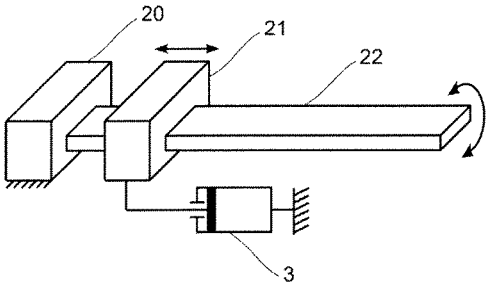
FIG. 12 shows a schematic view of a compliance element of an operator control element according to the invention according a twelfth embodiment.
Figure 12B:
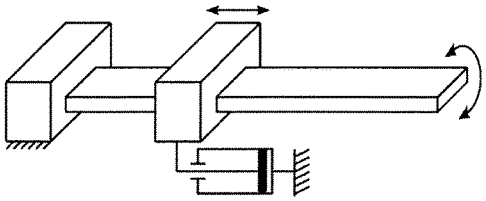

FIG. 12 shows a schematic view of a compliance element of an operator control element according to the invention according to a twelfth embodiment. In the left-hand part of the figure, the actuator unit 3 is in an extended state and in the right-hand part it is in a retracted state. In the twelfth embodiment there is provision to clamp a torsion spring 22 with a rectangular cross section tightly into a bearing block 20. A second bearing block 21 can be moved along the longitudinal axis of the torsion spring 22 by an actuator unit 3, wherein the second bearing block 21 absorbs all the torsional torques. The free end of the torsion spring 22 is arranged at the pivot point 2 of the activation lever 1. The characteristic of the torsion spring 22 and therefore the characteristic curve of the operator control element can be adjusted by displacing the movable bearing block 21 along the longitudinal axis of said torsion spring 22. By means of suitable stops it is also possible to ensure here that the operator control element remains fully functionally capable in the event of a malfunction of the actuator unit. As an alternative to the torsion spring 22, according to the invention a leaf spring which is clamped in on one side is provided as a bending spring.

Figure 13A:
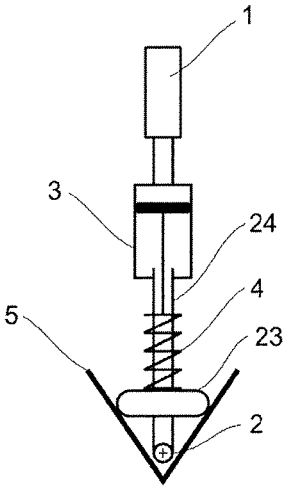
FIG. 13 shows a schematic view of an operator control element according to the invention according to a thirteenth embodiment.
Figure 13B:
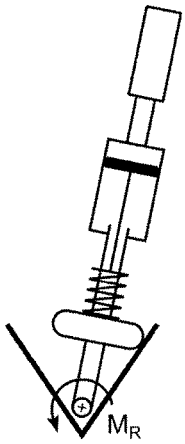

FIG. 13 shows a schematic view of an operator control element according to the invention according to a thirteenth embodiment. The operator control element is embodied as a joystick. In the left-hand part of the figure, the joystick is in a neutral state with the actuator unit 3 retracted and in the right-hand part it is in a deflected state with the actuator unit 3 retracted. In the thirteenth embodiment, a tappet 23 slides on the cam 5. It is particularly advantageous that the entire mechanism which is relevant for the invention is arranged on a handlebar 24, facing the user, of the activation lever 1 on this side or above the pivot point 2. The actuator unit 3 is securely connected to the activation lever 1 in order to modulate the prestress of the compliance element 4. The compliance element 4 is preferably embodied as a helical spring which engages around the activation lever 1 and is arranged so as to slide thereon. This results in a particularly compact arrangement. If the activation lever 1 is deflected owing to the cam 5 the tappet 23 moves away counter to the spring force $F_F$ of the compliance element 4. In this way a resetting torque $M_R$ is generated.

Figure 14A:
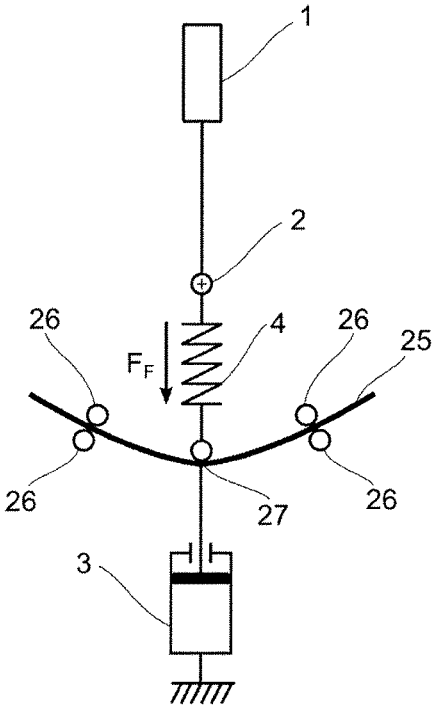
FIG. 14 shows a schematic view of an operator control element according to the invention according to a fourteenth embodiment.
Figure 14B:
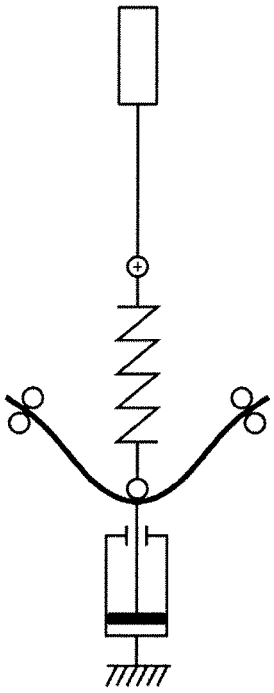

FIG. 14 shows a schematic view of an operator control element according to the invention according to a fourteenth embodiment. The operator control element is embodied as a joystick. In the left-hand part of the figure the joystick is in a neutral state with the actuator unit 3 extended, and in the right-hand part it is in a neutral state with the actuator unit 3 retracted. In the fourteenth embodiment, the cam 25 is not only embodied so as to be displaceable in parallel by the actuator unit 3 but is also of flexible design and is mounted loosely between four bearings 26. The actuator unit 3 modulates the shape of the cam 25. In this embodiment, at the same time the prestress of the compliance element 4 and the distance between a bearing point 27 of the probe element on the cam and the pivot point 2 are changed. Instead of a single actuator unit 3, a plurality of actuator units 3 can also act at different locations on the flexible cam 25 and change their shape. This results in a plurality of degrees of freedom during the modulation of the characteristic curve. So that the activation lever 1 returns into its neutral position under all circumstances, the actuation travel of the actuator units 3 can be limited by means of intrinsic actuation travel limitation means or stops in such a way that the actuator units 3 cannot give the flexible cam 25 a shape which contains local extremes in the profile of the potential energy of the probe element.

LIST OF REFERENCE SYMBOLS

1 Activation lever
2 Pivot point
3 Actuator unit
3*a* Actuator unit
3*b* Actuator unit
3' Actuator unit
4 Compliance element
4*a* Compliance element
4*b* Compliance element
5 cam
6 Adjustable compliance element
7 Gas pressure
8 cam
9 Force engagement point
10 Stop
11 Joint
12 Joint
13 Sliding block
14 cam roller
15 Bearing
16 Magnet
17 Magnet
18 Magnet
20 Bearing block
21 Bearing block
22 Torsion spring
23 Tappet
24 Handlebar
25 cam
26 Bearing
27 Bearing point
$F_B$ User force
$F_F$ Spring force
$F_R$ Resetting force
p Gas pressure
$M_R$ Resetting torque

The invention claimed is:

1. Operator control element comprising a housing, an activation lever (1) which is mounted in the housing so as to be pivotable about a pivot point (2), and a resetting unit for making available a resetting torque ($M_R$) for resetting the activation lever (1) from a deflected state into a neutral state, wherein the operator control element comprises an actuator unit (3) which is operatively connected to the resetting unit, wherein the resetting torque ($M_R$) is limited modulatable by the actuator unit (3), wherein in the case of a lower modulation limit the resetting torque ($M_R$) is greater than zero in the deflected state, wherein the resetting unit has a cam (5), and a probe element which contacts the cam (5) in any position of the activation lever (1), wherein a contact force of the probe element against the cam (5) is modulatable in terms of absolute value and/or direction by the actuator unit (3), characterized in that various different cams (5) can be accessed by rotating a cam roller (14), wherein the probe element has a ball or a roller or a cam.

2. Operator control element according to claim 1, characterized in that the compliance element (4) has a compression spring or a tension spring or a gas piston or a magnet.

3. Operator control element according to claim 1, characterized in that the resetting unit has a compliance element (4), wherein a prestress of the compliance element (4) is modulatable by the actuator unit (3).

4. Operator control element according to claim 1, characterized in that an intrinsically limited actuation travel is made available by the actuator unit (3).

5. Operator control element according to claim 1, characterized in that the operator control element has stops for limiting an actuation travel of the actuator unit (3).

6. Operator control element according to claim 1, characterized in that the actuator unit (3) has an actuator, wherein the actuator is embodied as an electric motor or an electrodynamic linear drive or a piezoelectric drive or an electromagnet or a pneumatic drive or a hydraulic drive.

7. Operator control element according to claim 1, characterized in that the actuator unit (3) has an actuator element instead of an actuator.

8. Operator control element according to claim 1, characterized in that the pivot point (2) is embodied as an activation axis.

9. Operator control element according to claim 1, characterized in that the resetting torque in the deflected state is 0.001 Nm to 10.0 Nm.

* * * * *